United States Patent [19]

Meyer

[11] Patent Number: 4,750,298

[45] Date of Patent: Jun. 14, 1988

[54] METHOD AND DEVICE FOR CONTROLLING THE DRIVE OF DIFFERENT SUCCESSIVELY OPERATED GRINDING DISKS

[75] Inventor: Hans-Robert Meyer, Hamburg, Fed. Rep. of Germany

[73] Assignee: Ernst Winter & Sohn (GmbH & Co), Hamburg, Fed. Rep. of Germany

[21] Appl. No.: 917,001

[22] Filed: Oct. 9, 1986

[30] Foreign Application Priority Data

Oct. 10, 1985 [DE] Fed. Rep. of Germany ..... 3536129

[51] Int. Cl.[4] ..... B24B 49/00

[52] U.S. Cl. ..... 51/165 R; 51/165.88; 51/134.5 R

[58] Field of Search ..... 51/165.72, 165.87, 165.88, 51/134.5 R, 165 R

[56] References Cited

U.S. PATENT DOCUMENTS

| | | | |
|---|---|---|---|
| 2,287,449 | 6/1942 | Price | 51/134.5 R |
| 2,641,875 | 6/1953 | Kirby | 51/134.5 R |
| 3,250,043 | 5/1966 | Finkl | 51/134.5 R |
| 3,423,883 | 1/1969 | Storck | 51/134.5 R |
| 4,558,686 | 12/1985 | Ono | 51/134.5 R |
| 4,566,226 | 1/1986 | Kimura | 51/134.5 R |

*Primary Examiner*—Harold D. Whitehead
*Attorney, Agent, or Firm*—Michael J. Striker

[57] ABSTRACT

A method and a device for controlling a drive of successively operated grinding disks which are made of different compositions. The condition, for example metallic inclusions or the like, in each individual grinding disk is scanned by means of a sensor the signal of which is fed to a signal transmitter and stored in a storage connected to the drive of the grinding disks, which is thereby controlled.

12 Claims, 1 Drawing Sheet

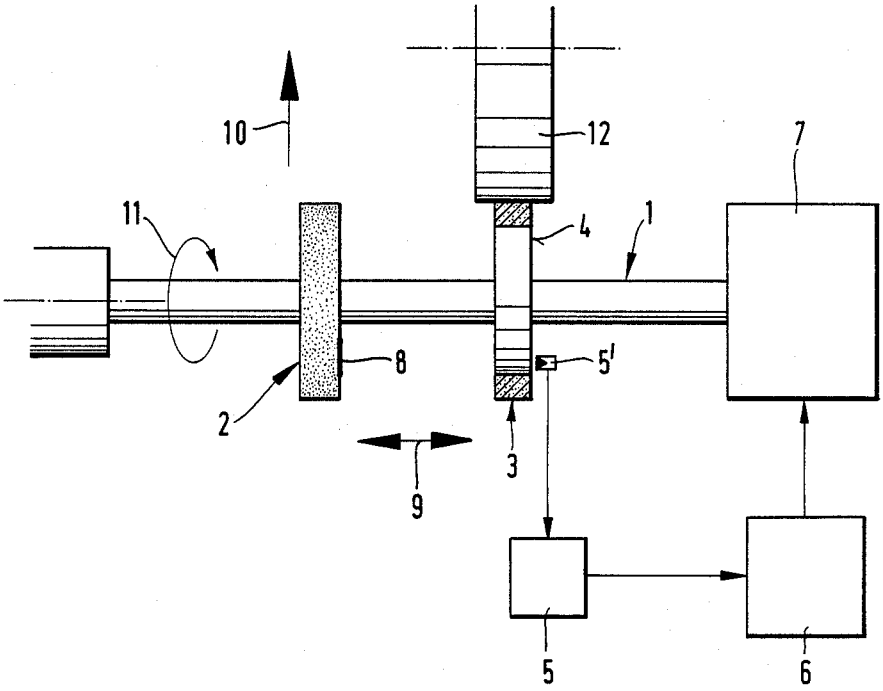
10
12
7
11
4
1
8
5'
2
3
9
5
6

METHOD AND DEVICE FOR CONTROLLING THE DRIVE OF DIFFERENT SUCCESSIVELY OPERATED GRINDING DISKS

BACKGROUND OF THE INVENTION

The invention relates to a method and a device for controlling the drive of different successively operated grinding disks.

In the grinding technology grinding disks of different types are used in the same machine. These grinding disks are either so-called conventional grinding disks with corundum or silicon carbide in a ceramic or bakelitic binding or grinding disks with diamond or cubic-crystalline boron nitride. Grinding disks with diamond or cubic-crystalline boron nitride are basically structured differently from the conventional grinding disks, because in the conventional grinding disks the total grinding disk body consists of grinding substances and a binder, while in grinding disks with diamond or cubic-crystalline boron nitride there is a difference between the grinding layer, on the one hand, consisting of the grinding substance, the binder and, if need be, the filler material, and on the other hand the basic body on which this grinding layer is mounted. In this type of grinding disks the basic body usually consists of metal and in particular of steel, aluminum or bronze, or a metal powder-phenol resin molded mass or a phenol resin with nonmetallic filler material.

Guidelines for the maximum permissible rotational speed during grinding do exist for conventional grinding elements. However, no such guidelines exist for grinding disks with diamond and cubic-crystalline boron nitride. However, it is known that in grinding disks with diamond or cubic-crystalline boron nitride the blow up speed and thereby the maximum rotational speed to be realized during the grinding process depends from the hardness of the basic body. These types of grinding disks are already used in practice with rotational speeds up to 150 m/s and the tendency is for even higher rotational speeds. With conventional grinding disks, in particular in such with a ceramic binding, such rotational speeds cannot be realized due to their breaking behavior. These grinding disks explode with rotational speeds which are possible for grinding disks with diamond or cubic-crystalline boron nitride.

For both of the mentioned types of grinding disks, namely conventional grinding disks and such with cubic-crystalline boron nitride, different use requirements exist or possibilities for their use with respect to the rotational speeds of the grinding disks. Moreover, due to the different grinding characteristics of the grinding substances there also exist different requirements and possibilities with respect to other grinding conditions, namely in particular the feeding speed and the delivery speed for the grinding disks.

When using different grinding disks and in particular grinding disks of a different type of grinding on the same machine different adjustment conditions must be taken into concideration. This is particularly true when grinding disks of different types are mounted on the same grinding spindle and in a method whereby the grinding spindle with respect to the position of the work piece comes into successive engagement or if a plurality of grinding spindles with different grinding disks are coming into successive engagement, like, for example, in multispindle grinding machines, whereby the grinding spindles may be disposed turret head fashion in the operating chamber of the machine.

SUMMARY OF THE INVENTION

Basically, the optimum grinding positions for grinding disks of different types may be determined prior to their use. It is an object of the invention to provide a method and a device for controlling the drive of a grinding spindle in dependency from the condition of the grinding disk being used in a plurality of different types of grinding disks. As a solution it is provided that the condition of the grinding disk is scanned with a signal transmitter and is fed into a data storage which controls the drive of the grinding disk or its grinding spindle by means of preset data. Thereby, the optimum data for the condition of the grinding disk are called from a data block available in a numerical storage of the drive machine and are fed to the machine control. This is made possible in that the grinding disk is scanned by a sensor, before or after reaching its operating position, with respect to its composition or material condition or a geometric characteristic, and the result of the scanning is used as a decision making aid for calling the grinding parameters from the machine processor.

BRIEF DESCRIPTION OF THE DRAWING

The single figure of the drawing schematically shows a device for controlling a drive of different grinding discs according to the invention.

DETAILED DESCRIPTION OF THE PREFERRED EMBODIMENT

In an exemplified embodiment two grinding disks 2 and 3 are mounted on a spindle 1 for processing a workpiece 12, that is, a conventional grinding disk 2 made of corundum in a ceramic binding with nonmetallic filler materials and a grinding disk 3 with cubic-crystalline boron nitride in phenol resin binding with nonmetallic filler materials, whereby the grinding layer of the grinding disk 3 is mounted on a basic body 4 made of aluminum. Both grinding disks 2 and 3 have different optimum grinding conditions. When using disk 3 with cubic-crystalline boron nitride a rotational speed of 80 m/s had been shown to be optimal; when using the conventional grinding disk 2 a rotational speed of 45 m/s has been proved to be optimal.

Before or after the positioning of the grinding disk 3, and also later the grinding disk 2, into their operating positions, a signal transmitter with a sensor or a scanning member 5' scans the given grinding disk so as to determine whether the basic body of the grinding disk contains metallic components. This is performed by the inductive signal transmitter 5. When the corresponding is true, that is, when a grinding disk 3 is used with cubic-crystalline boron nitride, whose grinding layer is mounted on the metallic basic body, the drive machine 7 directly switches the corresponding rotational speed by control through a data storage 6, that is, to a rotational speed according to arrow 11 in the magnitude of 80 m/s and, if need be, in addition the optimum feeding and delivery speed in the direction of arrows 9,10 of the grinding disk 3 with respect to the workpiece 12. If it is found during scanning that the basic body 4 does not contain any metallic components, the rotational speed is switched to 45 m/s. If a grinding disk does not contain any metallic components, the control may be realized by using a signal transmitter 5 with an optical sensor 5'. For this purpose, a disk 2 is provided with a marking or a reflecting layer 8 which may be formed of a tin foil segment, for example, which causes a corresponding signal to be fed through the optical sensor 5' and into the data storage 6 for supplying a data. Also, a special geometry of the grinding disk in the area of the sensor 5' may be so shaped that different signals are emitted.

It will be understood that each of the elements described above, or two or more together, may also find a useful application in other types of methods and devices for controlling different types grinding disks differing from the types described above.

While the invention has been illustrated and described as embodied in a method and device for controlling different type grinding disks, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a method for controlling the drive of successively operated grinding disks (2,3) which are made of different grinding materials and are individually and successively applied to a workpiece at different grinding conditions, the improvement comprising the steps of scanning a condition of an individual grinding disk (2,3) to be applied to the workpiece in dependence on a grinding material thereof by means of a signal transmitter (5,5') which issues a signal indicative of said condition , and storing said signal in a data storage which controls a drive (7) of said grinding disks (2,3) so as to adjust a speed of the disk applied to the workpiece in dependence on the scanned condition of said disk.

2. Method in accordance with claim 1, wherein a rotational speed (11) of a grinding spindle (1) is controlled.

3. Method in accordance with claim 1, wherein a delivery speed and a feeding speed (10) of a respective grinding disk (2, 3) are controlled.

4. Method in accordance with claim 1, wherein said transmitter is an inductive transmitter and the condition of each grinding disk (2,3) in inductively scanned.

5. Method in accordance with claim 1 wherein the condition of the grinding disk (2,3) is optically scanned.

6. Method in accordance with claim 1, wherein the condition of the grinding disk (2,3) is scanned during a movement of a respective disk into an operating position thereof.

7. In a device for controlling a drive of grinding disks which are made of different grinding materials and are individually and successively applied to a workpiece at different grinding conditions, the improvement comprising means for scanning the condition of each individual grinding disk to be applied to the workpiece in dependence on a grinding material thereof, said means including a signal transmitter provided with a scanning member (5') for scanning the condition of the grinding disk (2,3) and which controls the drive of a spindle of the grinding disk; and a data storage (6) interconnected between said transmitter and said drive and storing a signal from said transmitter to control said drive so as to adjust a speed of the disk applied to the workpiece in dependence on the scanned condition of said disk.

8. Device in accordance with claim 7, wherein said scanning member is a sensor (5') and said transmitter is an inductive signal transmitter.

9. Device in accordance with claim 12, wherein a grinding disk (2) to be scanned is provided with a marking (8) for a sensor (5') of said signal transmitter.

10. Device in accordance with claim 7, wherein the signal transmitter (5) controls a feeding speed (10) of the grinding disk (4) in dependency from the condition of the grinding disk (2,4) by means of the data storage (6).

11. Method in accordance with claim 1, wherein said signal transmitter determines whether a basic body of the grinding disk contains metallic components.

12. Device in accordance with claim 7, wherein said transmitter is an optical signal transmitter.

* * * * *